US005118402A

United States Patent [19]

Engels et al.

[11] Patent Number: 5,118,402

[45] Date of Patent: Jun. 2, 1992

[54] ELECTROLYTIC SILVER RECOVERY SYSTEM FOR RECOVERING SILVER FROM PHOTOGRAPHIC FIXING SOLUTIONS

[75] Inventors: Herman M. Engels, Wuustwezel; Marc A. de Niel, Brussel; Bartolomeus J. Verlinden, Genk, all of Belgium

[73] Assignee: Agfa-Gevaert N.V., Mortsel, Belgium

[21] Appl. No.: 612,851

[22] Filed: Nov. 14, 1990

[30] Foreign Application Priority Data

Nov. 20, 1989 [EP] European Pat. Off. ..... 89202933.1

[51] Int. Cl.[5] ..... C25B 9/00

[52] U.S. Cl. ..... 204/232; 204/233; 204/234; 204/237; 204/275; 204/109

[58] Field of Search ..... 204/109, 232, 233, 234, 204/237, 275

[56] References Cited

U.S. PATENT DOCUMENTS 4,028,199 6/1977 Holland ..... 204/114

4,379,082 4/1983 Gauchon ..... 204/96

*Primary Examiner*—John Niebling

*Assistant Examiner*—David G. Ryser

*Attorney, Agent, or Firm*—William J. Daniel

[57] ABSTRACT

An electrolytic silver recovery system for recovering silver from photographic fixing solutions, by means of an electrolytic cell (28) having an anode (52) and a cathode (53), and circulation pumps (29*a*, 29*b*) for removing solution from the cell and returning it to the cell, which device comprises a hydrocyclone (56) located in the liquid path (55) from the cell to the suction side of the pumps and connected at its outlet directly to the suction side of the pumps. The suction pressure of the circulating pump maintains a low pressure differential of less than about 0.6 bar between the inlet and outlet of the hydrocyclone which establishes the liquid flow through the hydrocyclone.

9 Claims, 4 Drawing Sheets

ELECTROLYTIC SILVER RECOVERY SYSTEM FOR RECOVERING SILVER FROM PHOTOGRAPHIC FIXING SOLUTIONS

BACKGROUND OF THE INVENTION

1. Field of the Invention

The present invention relates to an electrolytic silver recovery system for recovering silver from photographic fixing solutions.

2. Description of the prior art

In 1931, K. Hickman, C. Sanford and W. Weyerts describe in the JSPE, Vol. 17, p. 568-590 a technique for "The electrolytic regeneration of fixing baths". This was the first practical technique to provide for high-efficiency removal of silver from and reuse of the fixing bath.

Passage of an electric current through exhausted fixing bath in a cell provided with a cathode and an anode leads to the deposition of silver on the cathode. Adequate control of the electrolytic process not only enables the silver to be recovered economically, but also allows the fixing solution to be used over and over again, with occasional replenishment to compensate for fixing solution i.e., hypo carried among on the films removed from the bath.

In the performance of the above method, it was found that the operational lifetime of the pump or pumps that maintain a circulation of fixing solution through the cell, and/or also between the cell and the fixing tank of the processor, is seriously affected by the presence of silver particles in the liquid. It is believed that these particles arise from the cathode of the silver recovery cell where they become detached from the deposited silver layer under the influence of vibration, bad adhesion, etc. These particles are attracted to the impeller shaft of the pumps and damage thereby the bearing sleeve or the seal of the pumps which causes leakage of the pumps.

Filters in the liquid circuit upstream of the pumps operate not very satisfactorily because the troublesome silver particles are very fine so that they pass through the filter, whereas the coarser particles and any gelatin tend to prematurely clog the filter.

SUMMARY OF THE INVENTION

Object of the invention

It is an object of the present invention to provide an electrolytic silver recovery system for recovering silver from fixing solutions used in photographic processing apparatus, which does not cause a rapid deterioration of the pump means in the liquid circuit.

Statement of the invention

According to the invention, an electrolytic silver recovery system for recovering silver from fixing solutions used in photographic processing apparatus, which comprises an electrolytic cell with an anode and a cathode, and circulation pump means for the cell which withdraws the electrolyte solution directly from the cell and returns same to the cell, is characterised by the inclusion of at least one hydrocyclone in the liquid path from the cell to the suction end of the pump means, the feed inlet opening of the hydrocyclone being in communication with the liquid in the cell, outlet of the hydrocyclone being in communication with the suction end of the pump means, and the bottom opening of the hydrocyclone discharging to collection means for collecting solid particles removed from the fixing solution.

The satisfactory operation of a hydrocyclone in the described system is surprising since the pressure difference that can be established over the cyclone is limited because it is achieved by a reduction in the atmospheric pressure i.e. a negative pressure, at the vortex overflow outlet caused by the pump means whereas conventional hydrocyclones operate with an overpressure at the feed inlet opening. The pressure difference which is based on an underpressure (suction) is limited (theoretically 1.0 bar), whereas one that is based on the use of an overpressure may amount to many bars. Yet it has been established that a hydrocyclone in the described application forms a very efficient tool for the removal of solid particles from the fixing liquid that otherwise would considerably shorten the life of the pumps in the liquid circuit.

The hydrocyclone is a completely static component in the circuit that is maintenance-free.

In a suitable embodiment of the invention, the hydrocyclone is simply hung in the electrolytic cell, its inlet opening being below the level of the liquid in the cell.

According to a further suitable embodiment of the invention, the collector for collecting solid particles discharged at the discharge opening forms part of the hydrocyclone. In this way, the only connection of the hydrocyclone in the circuit may comprise a liquid conduit at its vortex outlet. For emptying the collector, the conduit to the pump is disconnected from the vortex outlet, and the hydrocyclone may be lifted from the recovery cell. The collector may be in the form of a small pot, liquid-tightly screwed on the bottom end of the hydrocyclone, and be arranged for easy closure for transport to another location for separation and/or recovery of the collected silver.

BRIEF DESCRIPTION OF THE DRAWINGS

The invention will be described hereinafter by way of example with reference to the accompanying drawings, wherein:

Referring to FIG. 1, a photographic film processor 10 which comprises a developing station 11, a fixing station 12 and a rinsing or washing station 13, is connected to an ecologic processing unit 15 which comprises a module 16 with a holder 17 for used developer and a holder 18 for used fixer, a module 19 for the recovery of silver from the fixing liquid, and a module 20 for the recovery of silver from the wash water.

Figure 1:
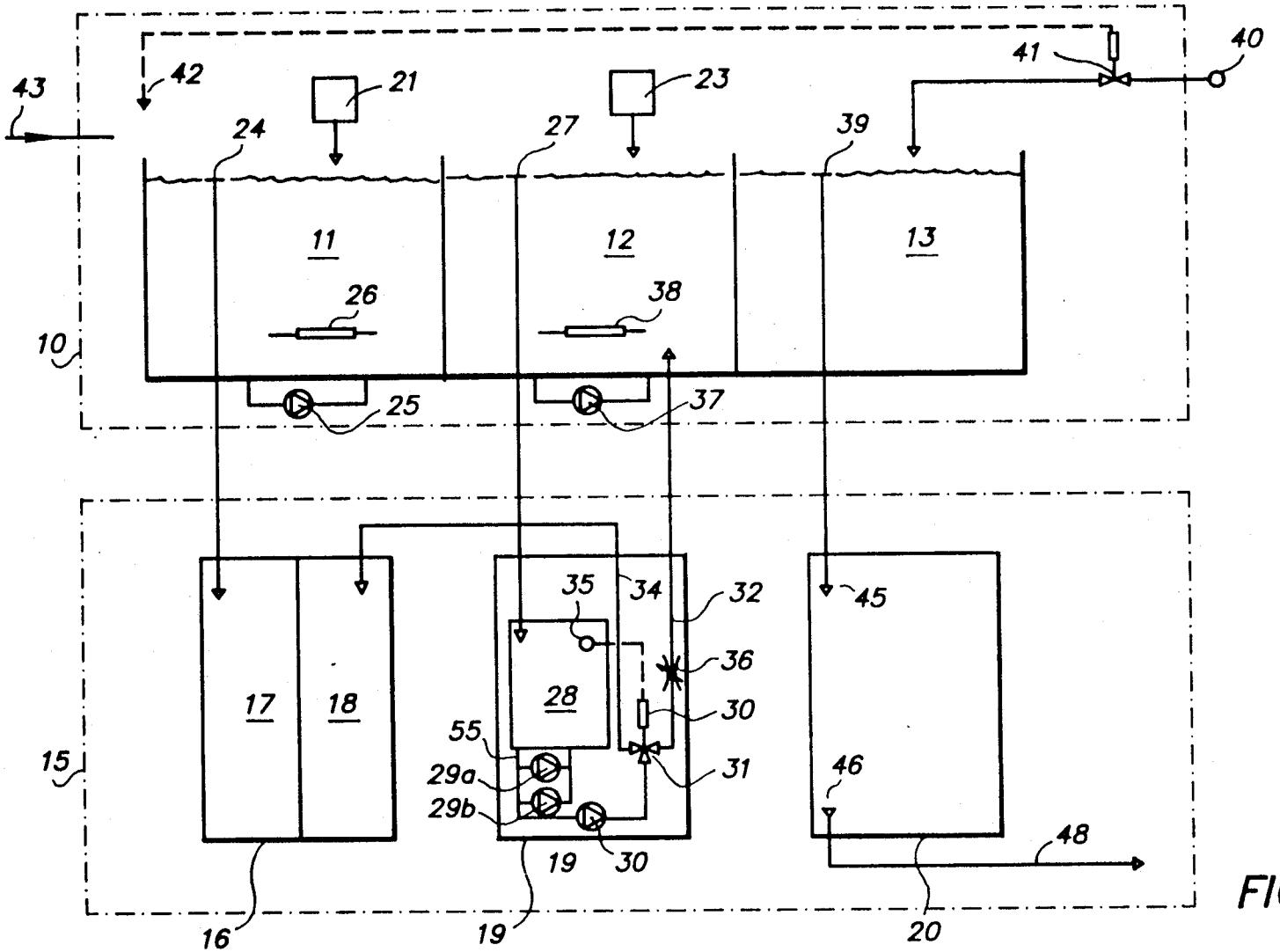
FIG. 1 is a diagrammatic illustration of one embodiment of a photographic film processor and an ecologic processing unit connected therewith.

The processor 10 and the unit 15 have been illustrated as separate units in FIG. 1, and in practice they may be located close to each other or even be arranged in separate rooms. However, the unit 15 may also be integrated into the processor 10. The holders 17 and 18 may be in the form of small tanks, jerrycans, canisters, and the like.

The developing station 11 comprises a make-up system 21 for replenishing the station as developer is being consumed by the developed film and dragged into the fixing station. In a similar way, the fixing station 12 comprises a make-up system 23 for the fixing liquid. The tanks of the respective processing stations may be deep tanks with film transport racks, or tray-like tanks for a nearly horizontal film transport path. The cross-over between adjacent tanks may be provided with squeegee means For limiting the transfer of processing liquid into the next tank.

The developing station has an overflow 24 which controls the liquid level in the station, and which leads to the holder 17.

A pump 25 maintains a circulation of developing liquid through the station. A heater element 26 controls the temperature of the developer.

The fixing station has an overflow 27 which conducts towards the electrolytic silver recovery cell 28 of the module 19. Pumps 29*a* and 29*b* operate in parallel for circulating the fixing liquid through the cell 28, whereas a pump 30 pumps liquid from the cell to a three-way valve 31 that conducts normally the liquid back to the fixing station, via the conduit 32, but that may also conduct the liquid through a conduit 34 to the holder 18 for used fixing liquid. The valve 31 is controlled in response to the signal from a level sensor 35 in the cell 28, and in case the liquid level in the cell 28 exceeds a set value, as after the addition of make-up liquid to the fixing station, the valve is switched to make the excess liquid flow to the holder 18.

An adjustable restrictor 36 serves to adjust the rate of flow of fixing liquid to the fixing station via line 32.

A pump 37 maintains a direct circulation of fixing liquid through the fixing station. A heater element 38 controls the temperature of the liquid.

The rinsing station 13 has an overflow 39 which leads to the module 20. Wash water is taken From a tap water connection 40 under the control of a valve 41 which is controlled by a sensor 42 in response to the introduction of a film 43 into the processor.

The module 20 is in fact an assembly of liquid tanks that contain resin cartridges with an ion-exchange resin which captures the silver that is present in the used wash water.

The inlet of the ion exchange tanks in the module 20 is indicated by the numeral 45 whereas 46 is the outlet of the tanks which goes to a conduit 48 and so to the sewer. The module 20 forms no part of the present invention and consequently no further information is given hereinafter on this subject. A detailed description of a suitable embodiment of an ion exchange silver recovery device for wash water may be found in our co-pending application EP 89 20 2932 entitled "A silver recovery device", filed on even day herewith.

The electrolytic silver recovery device of module 19 is described hereinafter in detail with reference to FIG. 2.

The cell 28 is formed by a generally rectangular tank 50 with a protruding partial top section 51. In the tank 50 there are provided a number of interleaved electrodes in the form of plates 52 which form the anode and plates 53 which form the cathode of the cell. The plates of a group are electrically connected in parallel, and are connected to a suitable source of electric DC supply, not illustrated in the drawing.

Figure 2:
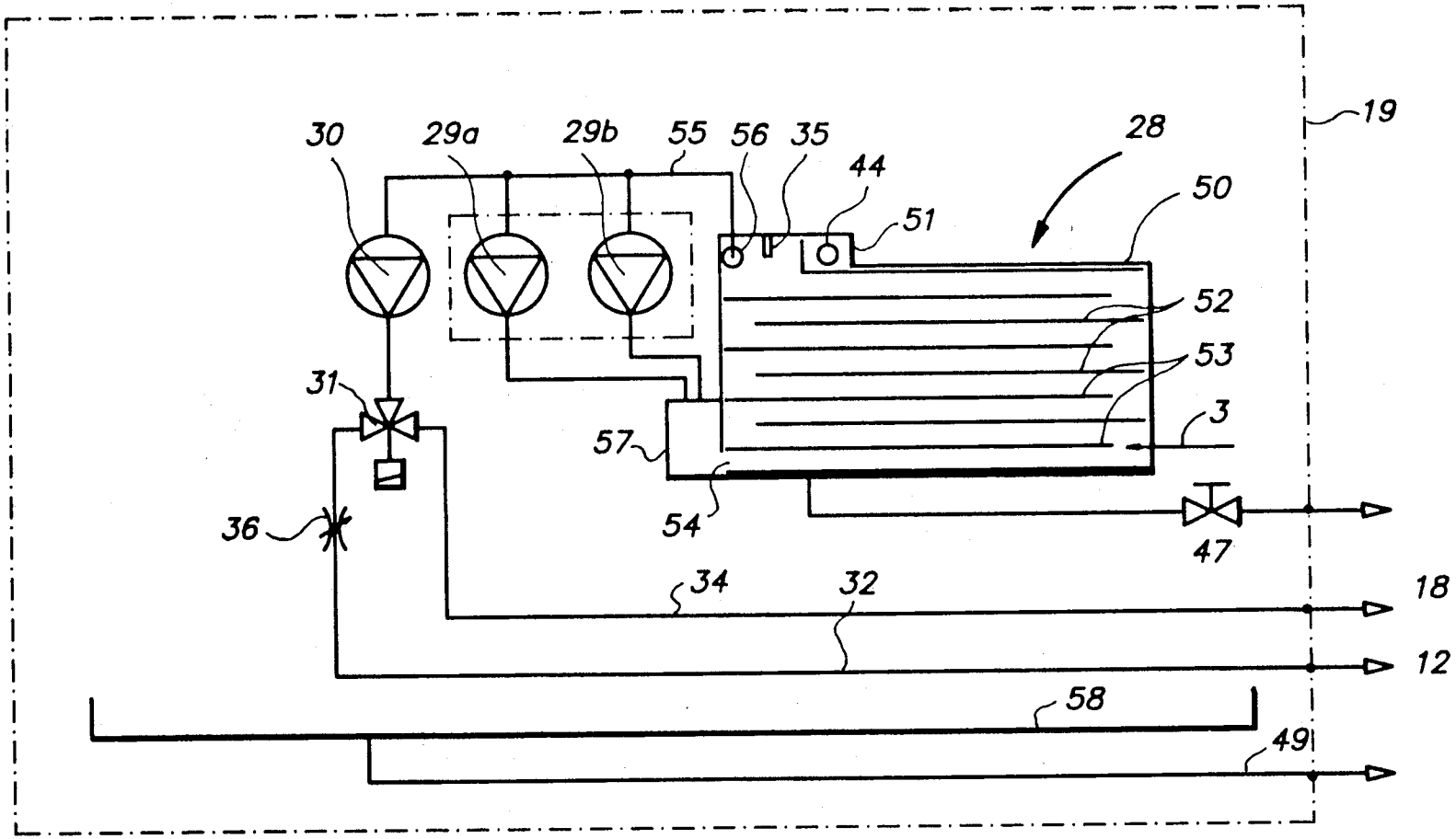
FIG. 2 is a diagrammatic representation of one embodiment of the cell for the electrolytic silver recovery of the ecologic processing unit.
Figure 3:
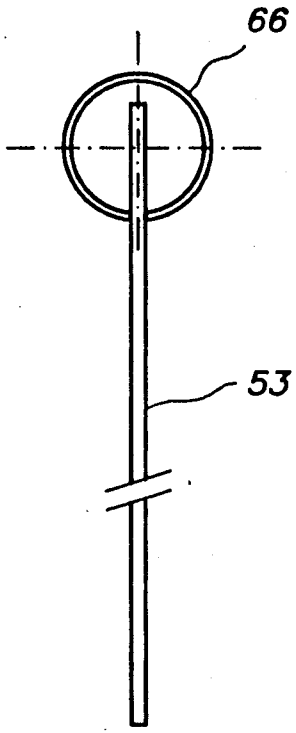
FIG. 3 is an enlarged view taken in elevation of a preferred cathode arrangement viewed in the direction of arrow 3 of FIG. 2.

In case the electrode plates are not made From a solid metal, such as stainless steel, but rather from a resin or polymer that has been made electrically conductive by the incorporation of conductive fibers or threads, such plates may in a suitable way be electrically conducted in the circuit through the intermediary of an elongated tubelike metal member that has a longitudinal slot in its wall, the electrode plate being clampingly engaged into said slot for electrical contact, as illustrated by the tube 66 for the plate 53 in FIG. 3 which is an enlarged view in elevation taken in the direction of the arrow 3 in FIG. 2.

The liquid inlet of the cell is formed by a vertical inlet port constrictor 54 through which liquid is pumped into the bottom of the cell and caused to follow a labyrinth-like path towards the top outlet at position 56. The constrictor 54 forms the slotlike outlet opening of a vertical feed chamber 57. The constrictor port causes a substantial increase in the speed of the liquid through the cell which is advantageous for a high electrolysis current in the cell, and an efficient removal of silver particles that may fall off the cathode and that might otherwise short-circuit the electrode plates in case of non-removal. By the term "removal" is meant in the present case the transport of the silver particles towards a hydrocyclone where they are eliminated from the liquid.

Fixing solution is pumped into the chamber at two vertically spaced positions, illustrated for the sake of clarity next to each other in FIG. 2, by the pumps 29*a* and 29*b*. The purpose of the two vertically spaced feed openings, in conjunction with the constrictor 54, is to produce a uniform flow rate along the height of the liquid channel through the electrodes. The cell may be emptied by a valve 47. The outlet of the valve discharges into the sewer, and so does the conduit 49 of a dripping pan 58 provided at the bottom the module 19.

Figure 5:
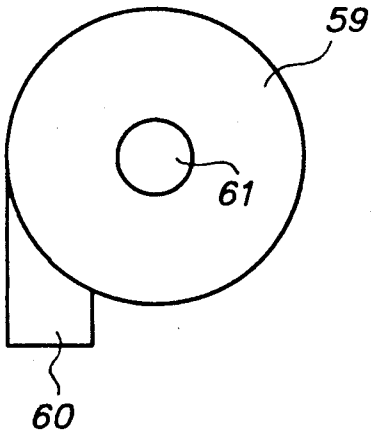
FIG. 5 is a top view of the hydrocyclone of FIG. 4.
Figure 4:
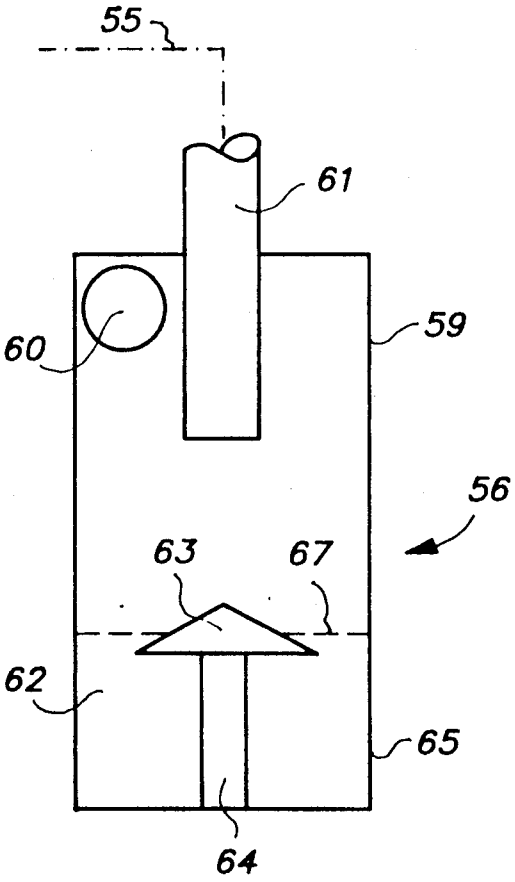
FIG. 4 is a schematic elevation view, of the silver removing hydrocyclone of the invention in the cell of FIG. 2.

The outlet of the cell illustrated schematically at 56 is in fact a hydrocyclone which is immersed into the liquid in the cell. This hydrocyclone is shown diagrammatically in FIGS. 4 and 5.

The hydrocyclone consists of a vertically arranged tubular body 59 with a tangential feed inlet 60, a vortex finder or outlet port 61, and at the bottom an annular gap 62 which is formed between the cylindrical wall of the body and a cone 63 which stands on a stud 64 in a cylindrical collector pot 65 which is screwed on the lower end of the hydrocyclone as indicated diagrammatically by the broken line 67.

The hydrocyclone is not fixedly mounted in the electrolytic cell, but is immersed therein in the same way an immersion pump is placed in a body of liquid. A bracket or the like may hold the hydrocyclone in position in the corner of the cell section 51.

The manifolding of the hydrocyclone comprises only the connection of the vortex finder 61 to the outlet pipework 55 which leads to the suction side of the pumps 29*a*, 29*b* and 30, see FIG. 2.

Apart from the hydrocyclone 56, there are provided in the section 51 of the cell the level sensor 35 and a reference electrode 44 for measuring the silver content of the fixing bath. Said electrode may be a so-called Calomel electrode, but for reasons of ecologic disposal the use of a silver/silver chloride electrode is preferred.

In the operation of the fixing liquid circuit of the described processor, the pumps 29*a* and 29*b* draw fixing liquid from the recovery cell 28 by establishing via the conduit 55 an (suction) at the vortex finder 61 whereby a reduced pressure is created at the feed inlet opening 60 that Is located below the level of the fixing liquid in the cell. Liquid enters the hydrocyclone through the feed opening and moves downwardly in an outer helical flow path towards the bottom of the cyclone where it begins to feed laterally to the centre thereby reversing its vertical direction and going up via an inner helical flow and out through the vortex finder 61.

Silver, and also other particles that are present in the liquid are captured by the cone 63, and are deflected towards the annular gap 62 where gravity makes them sink into the collector pot 65. The pot 65 is filled with fixing liquid which, however, is in an almost stationary condition with almost no vertical component of motion so that the deposited particles remain within the pot. The pot is fitted by a liquid-tight screwfitting to the lower end of the hydrocyclone as mentioned already, and has a capacity such that uninterrupted operation during many months is possible. The hydrocyclone operates as a very effective filter to remove solids from the fixing solution, and forms thereby a highly efficient protection for the pumps 29*a*, 29*b* and 30.

In an indirect way the hydrocyclone also gives protection for the pump 37, since this pump also makes part of the overall liquid circulation in the fixing station.

The reference electrode 44 continuously monitors the silver concentration of the fixing solution, and controls the DC power supply to establish an electrolysis current which produces the best results for the removal of silver from the particular fixing solution and for the deposition of silver on the cathode.

When the pot 65 must be emptied, the hydrocyclone is withdrawn from the cell 28, and the pot 65 is unscrewed from the hydrocyclone.

The following data illustrate by way of example one specific embodiment of the device described hereinbefore:

| | |
|---|---|
| Volume of cell 28 | 20 $dm^3$ |
| Cathode surface | 96 $dm^2$ |
| Cathode material: stainless steel | |
| Anode surface | 96 $dm^2$ |
| Anode material: carbonfibre reinforced carbon | |
| Width of constrictor 54 | 15 mm |
| Pumps 29a and 29b: centrifugal pumps, rate | 45 $dm^3 \cdot min^{-1}$ |
| Pump 30, rate | 30 $dm^3 \cdot min^{-1}$ |
| Rate adjusted by restrictor 36 | 1 $dm^3 \cdot min^{-1}$ |
| Volume of fixing station 12 | 10 $dm^3$ |
| Hydrocyclone 56 | |
| height | 30 cm |
| diameter | 4.5 cm |
| volume of pot 65 | 200 $cm^3$ |
| pressure difference between outlet and inlet | less than 0.1 bar |
| Maximum electrolysis current | 0.15 $A \cdot dm^{-2}$ of cathode surface |

The present invention Is not limited to the embodiment described hereinbefore.

The hydrocyclone may have other shapes than the illustrated cylindrical one. Thus, the hydrocyclone may have an inverted cono-cylindrical body as known in the art, the opening in the vertex of the cone serving to carry off the underflow which carries the solids. It is clear that in such case there must be a conduit from the vertex opening to a suitable receptacle for the removed solids.

The hydrocyclone may be in the form of an assembly which houses several small hydrocyclones. The assembly provides common feed and product collection of the cyclones.

The electrolytic cell 28 may be arranged for obtaining high electrolysis currents by reducing the distance between the anode and cathode plates to a small value e.g. down to 10 mm. However, such reduction of distance increases the risk for shortcircuiting the electrodes as silver fragments become detached from the cathode and become so located that, occasionally by agglomeration with other fragments, physical contact is made between the cathode and the anode. Also, the resistance to the liquid flow increases as the section of the passage decreases. Therefore, according to an alternative embodiment of the invention, the effective section for the liquid flow between the cathode and anode is reduced by the provision of a frame-like enclosure around the anode periphery, the open side of which is covered by a pervious member that has a non-neglectable flow resistance.

Figure 6:
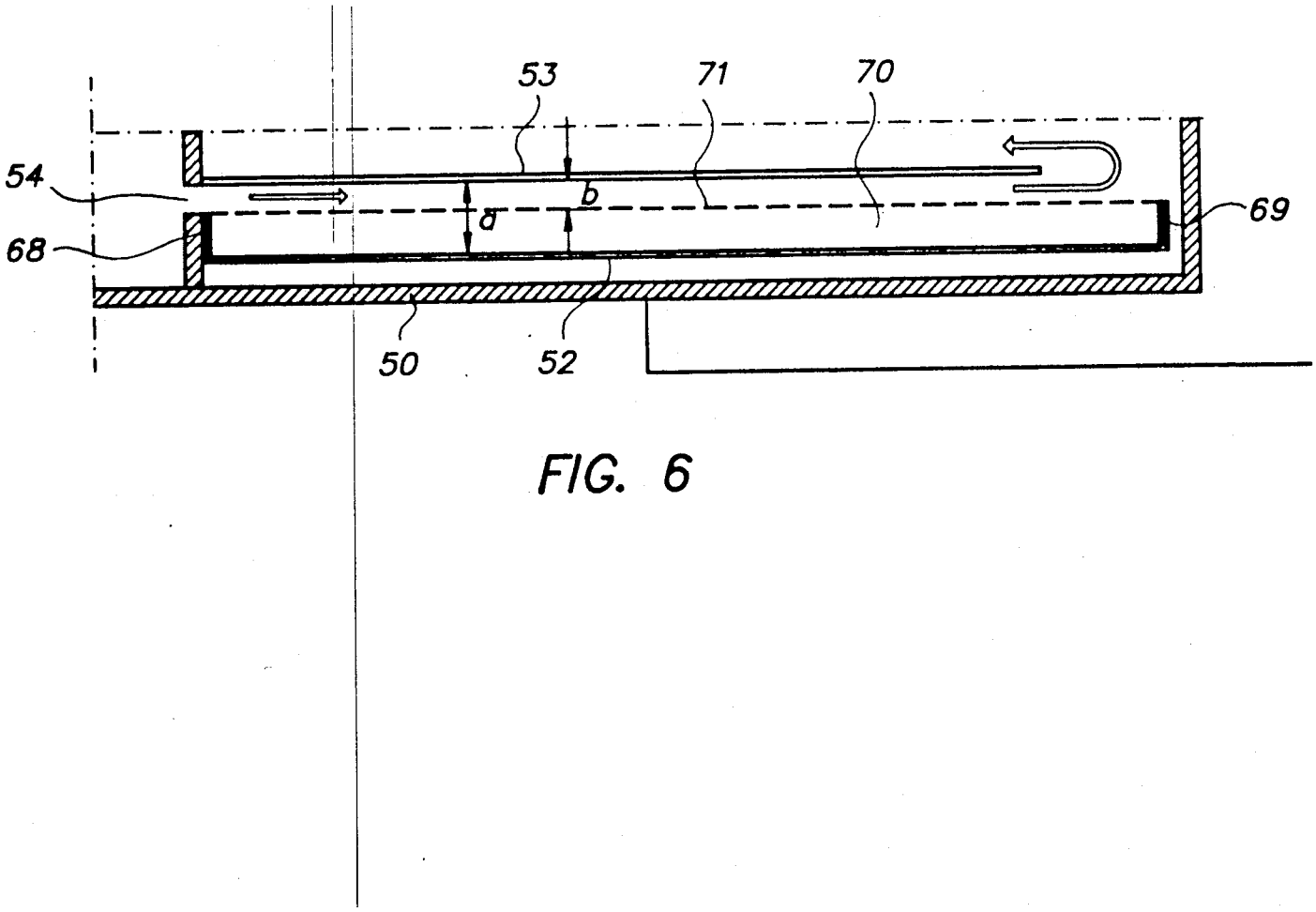
FIG. 6 is an enlarged fragmentary view in section of the bottom section of the electrolytic recovery cell of FIG. 2, showing a modified construction.

Referring to FIG. 6 which is an enlarged view of the bottom section of cell 88 in FIG. 2, the surface of the anode 52 which faces the cathode 53 is provided with a rectangular frame 70 of an electrically insulating material, two opposed walls of which are illustrated as 68 and 69.

The side of the frame which faces the cathode 53 is provided with a pervious wall 71 of an electrically insulating material. The opposed side of the frame is closed by the anode plate 52. This closure must not be liquid-tight and thus the frame may be held in place by simple locating means, for instance the frame may have projecting resilient fingers or studs that give support for the opposed cathode, so that the frame may be freely vertically slid between a cathode and anode.

The pervious wall 71 allows the passage of fixing liquid through its openings so that the space within by the frame 70 becomes filled with liquid. However the wall 71 presents a substantial resistance to the liquid flow through it, so that it causes a substantial increase of the liquid velocity in the clearance space between the wall 71 and the adjacent cathode 53. In other words the wall 71 has in fact reduced the original area of the opening between the electrode plates (which is proportional to the separation a) to a section which is proportional to the distance b between the wall 71 and the cathode 53. The Increased liquid velocity allows the use of a higher recovery current while yet the original distance between the electrodes remains unchanged so that there is no increased risk for shortcircuiting the electrodes, as would occur if the distance between the plates would have been physically reduced. Good results have been obtained with an arrangement the characteristics of which were as follows:

| | |
|---|---|
| distance a | 25 mm |
| distance b | 15 mm |
| plate 71: hard polyvinyl chloride | |
| thickness | 3 mm |
| openings | 3 × 3 mm |
| located on rows, spacing | 14 mm |
| columns, spacing | 7 mm |

It was found that the time which was required to go from a 100% electrolysis current (at the starting of the electrolysis) to a 37% current which was arbitrarily considered as the end of the operation, amounted to 35 minutes for a cell without the pervious plate 71, and to 15 minutes for one with that plate.

The anode plates of the silver recovery cell may be made from other materials than the mentioned carbon-fibre reinforced carbon, for instance carbon fibre reinforced polymers.

The fixing solution processed in the silver recovery cell 28 may be used for the regeneration of the ion exchange resin used in the module 20. To that end the conduit 32 may be diverted to enter into and then leave the module 20 so that processed fixing solution is passed through resin kept in separate tanks for its regeneration. The latter arrangement is described in detail in the co-pending application mentioned already.

The control of the electrolysis current on the basis of the voltage measured between the reference electrode 44 and the cathode may be improved by locating a help cathode in the form of a rod of silver in an electrically insulating way in the device, in the vicinity of the reference electrode 44, and by using the voltage difference between this cathode and the reference electrode as a measure of the silver content of the solution.

Finally, the control of the DC supply for the electrolysis may, apart from the measured silver content, also occur as a function of the type of fixing solution that is used in the fixing station 12.

I claim:

1. In an electrolytic recovery system for recovering silver from fixing solutions used in photographic processing apparatus, which comprises an electrolytic cell with an anode and a cathode for electrolytically treating said solution to deposit metallic silver on said cathode, and circulation pump means for removing treated solution after passage through the cell and for returning same to the cell, in combination, the improvement comprising at least one hydrocyclone in the flow path from the cell to the suction side of the circulation pump means for separating from the treated solution stray silver particles detached from said cathode, said hydrocyclone having its feed inlet in communication with the solution in the cell, its vortex outlet in direct communication with the suction side of the pump means, and its bottom opening leading to a collector for collecting silver particles separated from the electrolytically treated solution, said circulating pump means having a suction pressure sufficient to maintain a pressure differential between the feed inlet and vortex outlet of said hydrocyclone of less than about 0.6 bar and thereby establish flow of said treated solution through said hydrocyclone.

2. A system according to claim 1, wherein the hydrocyclone is mounted within the electrolytic cell with its feed inlet below the level of the solution in the cell.

3. A system according to claim 2, wherein the collector for collecting solid particles is disposed externally of the cell and can be emptied without removing the hydrocyclone from the cell.

4. A system according to claim 1, wherein the collector for collecting solid particles is integrally connected to the bottom of the hydrocyclone.

5. A system according to claim 4, wherein the hydrocyclone and the collector connected thereto, are arranged for immersion in the solution in the electrolytic cell.

6. A system according to claim 1, wherein the anode and the cathode of the cell are in the form of parallel plates stacked in alteration to form a labyrinth-like passageway for the solution in the cell, and wherein the inlet opening of the cell is in the form of a vertical slot in a cell side wall through which the fixing solution is fed between the anode and cathode.

7. A system according to claim 6, wherein said slot is in the form of a constricted opening which forms the outlet of a liquid feed chamber communicating with the cell and receiving solution to be treated.

8. A system according to claim 7, wherein solution is fed to said liquid feed chamber through at least two vertically spaced openings in a side wall of the chamber, each such opening being connected to an outlet of said pump means.

9. A system according to claim 6, wherein each such cathode plate is surrounded around its periphery by an upstanding frame and a pervious screen is supported by said frame in spaced parallel relation to said cathode plate to thereby restrict the effective flow area between the cathode and contiguous anode and thus accelerate the flow velocity of the solution therebetween while permitting access by the solution to the cathode plate.

* * * * *